US011584494B2

(12) United States Patent
Young

(10) Patent No.: US 11,584,494 B2
(45) Date of Patent: Feb. 21, 2023

(54) FRONT FACING ROWING BOAT

(71) Applicant: Robert S. Young, Snellville, GA (US)

(72) Inventor: Robert S. Young, Snellville, GA (US)

( * ) Notice: Subject to any disclaimer, the term of this patent is extended or adjusted under 35 U.S.C. 154(b) by 123 days.

(21) Appl. No.: 17/090,900

(22) Filed: Nov. 6, 2020

(65) Prior Publication Data

US 2022/0144400 A1 May 12, 2022

(51) Int. Cl.
*B63H 16/02* (2006.01)
*B63H 16/04* (2006.01)
*B63H 16/10* (2006.01)

(52) U.S. Cl.
CPC ..... *B63H 16/02* (2013.01); *B63H 16/04* (2013.01); *B63H 16/10* (2013.01)

(58) Field of Classification Search
CPC ..... B63H 16/00; B63H 16/02; B63H 16/04; B63H 16/06; B63H 16/10; B63B 17/00; B63B 35/00; B63B 35/79
USPC ..... 114/363; 440/104, 102
See application file for complete search history.

(56) References Cited

U.S. PATENT DOCUMENTS 4,052,951 A * 10/1977 Farr ..... B63H 16/10 440/105
5,938,489 A 8/1999 Mc Neil
6,640,741 B1 * 11/2003 Myers ..... B63B 35/34 114/352
7,517,267 B2 * 4/2009 Nesseth ..... B63H 16/105 440/105
8,550,025 B2 * 10/2013 Machida ..... B63H 16/02 114/363
10,124,865 B2 11/2018 Bridges

* cited by examiner

*Primary Examiner* — Lars A Olson
(74) *Attorney, Agent, or Firm* — Laura Witbeck

(57) ABSTRACT

An apparatus for a boat includes a lower rail, a seat support slidably mounted to the lower rail, an upper set of rails connected to the seat support with at least one rail support supporting each upper rail in the upper set of rails, and two paddle holders, each paddle holder slidably mounted to one of the upper rails in the upper set of rails. The paddle holders pivot relative to the upper rails, such that when paddles are attached, the paddles holders are capable of lowering and raising the paddles in and out of the water.

19 Claims, 15 Drawing Sheets

FRONT FACING ROWING BOAT

BACKGROUND

Different types of row boats are designed to allow a rider to move an oar or paddle through the water to propel the boat forward and may include, for example, canoes, kayaks, and rowing boats. For example, in a conventional canoe, a rider, who is seated in the canoe facing forward, in the direction of propulsion, may move a detached paddle in the water in backwards direction in order to move the boat forward. The rider may hold the handle of the paddle with one hand and the shaft of the paddle in the other hand. The rider may then lower the blade of the paddle into the water so that the blade of the paddle extends in a generally outward direction from the boat, and while the blade is in the water, the rider may pull the blade from fore to aft, generally parallel with the boat. After the pull, the blade may be lifted out of the water and moved forward to repeat the rowing process.

As another example of row boats, rowing boats may be used in the sport of crew and range in size and design to hold different amounts of riders. FIG. 1 shows an example of a typical rowing boat 10, as it would be used by a rower 11 moving through the water 12. Rowing boats 10 are distinguished from other types of row boats in that the oars 13 are held at a pivot point 14 on the boat by oarlocks, and rowers 11 face backward (from the direction 15 of propulsion) while rowing. The oars 13 may pivot about the pivot point 14 in a rotational direction around an axis extending generally perpendicularly to the length of the oar 13 and into the water 12. Further, rowing boats 10 may have a sliding seat 16 held in a racing shell 17, in which a rower 11 may slide and use force from their legs to aid in moving an oar 13 through the water 12. For example, in a rowing stroke, the oar blade 18 may be placed in the water 12 behind the rower 11 at the catch of the stroke, and as the rower 11 pushes backwards in the sliding seat 16, the blade 18 may move through the water 12 relative to the shell 17 in an opposite direction from the sliding motion. In such manner, the rower 11 may move the boat 10 forward, in a direction opposite from which the rower faces.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to an apparatus for a boat that includes a lower rail, a seat support slidably mounted to the lower rail, an upper set of rails connected to the seat support with at least one rail support supporting each upper rail in the upper set of rails, and two paddle holders, each paddle holder slidably mounted to one of the upper rails in the upper set of rails.

In another aspect, embodiments of the present disclosure relate to rowing boats that have a boat shell, a sliding seat assembly mounted on the boat shell, the sliding seat assembly having a lower rail extending parallel with a length of the boat shell, a seat support slidably mounted to the lower rail, and a seat disposed on the seat support. Rowing boats may further include rail supports connecting an upper set of rails to the seat support, wherein the upper set of rails has a first upper rail and a second upper rail positioned on opposite lateral sides of the seat, wherein each of the first and second upper rails are pivotably mounted to the rail supports, such that each of the first and second upper rails partially rotate around an axis parallel with the first and second upper rails, and wherein the upper set of rails and connected seat support are slidable with respect to the lower rail. Rowing boats of the present disclosure may further include a first paddle holder slidably mounted to the first upper rail and a second paddle holder slidably mounted to the second upper rail.

In yet another aspect, embodiments of the present disclosure relate to methods of assembling a boat that includes providing a seat support slidably connected to at least one lower rail, wherein the seat support is slidable along an axial length of the at least one lower rail, attaching a first upper rail to the seat support using at least one first rail support, attaching a second upper rail to the seat support using at least one second rail support, wherein the second upper rail is attached to a side of the seat support opposite from the first upper rail, and slidably mounting a paddle holder to each of the first and second upper rails.

Other aspects and advantages of the claimed subject matter will be apparent from the following description and the appended claims.

DETAILED DESCRIPTION

Embodiments disclosed herein relate generally to row boats and boat adaptation assemblies for boats that allow a rower to face in the same direction the boat moves as the rower moves a paddle through the water to propel the boat forward, referred to herein as the forward direction. As used herein, a row boat may refer to a boat having a boat shell or body capable of floating on water and supporting the weight of at least one rower. Row boats disclosed herein may be propelled forward through the water using paddles, which may be substantially formed of a single shaft extending from a handle portion at a first axial end of the paddle to a blade at an opposite, second axial end of the paddle.

Boat adaptation assemblies according to embodiments of the present disclosure may be used with different shapes, sizes, and types of boat bodies to provide a row boat that allows a rower to face forward while rowing (where the rower faces in the same direction as the boat when the boat moves forward). Further, depending on the size, shape, and type of boat body, paddles may be selected to have a length that may extend from the rower to the water during rowing.

Figure 1:
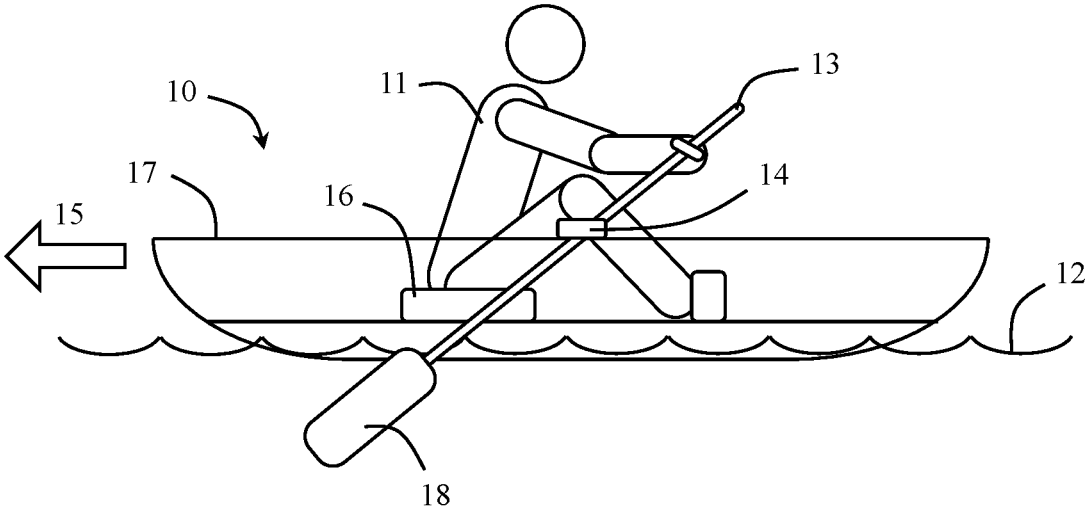
FIG. 1 (Prior Art)
FIG. 1 shows a diagram of a typical rowing boat as it moves through the water.
Figure 2:
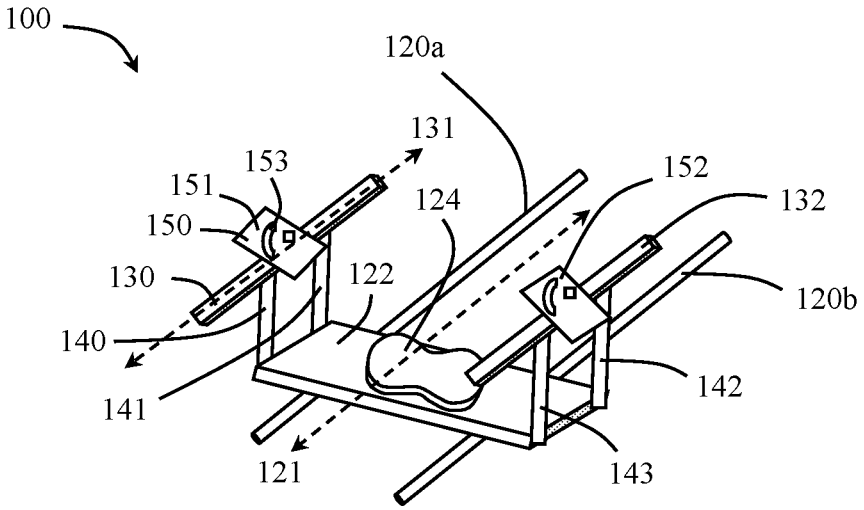
FIG. 2 shows a perspective view of a boat adaptation assembly according to embodiments of the present disclosure.
Figure 3:
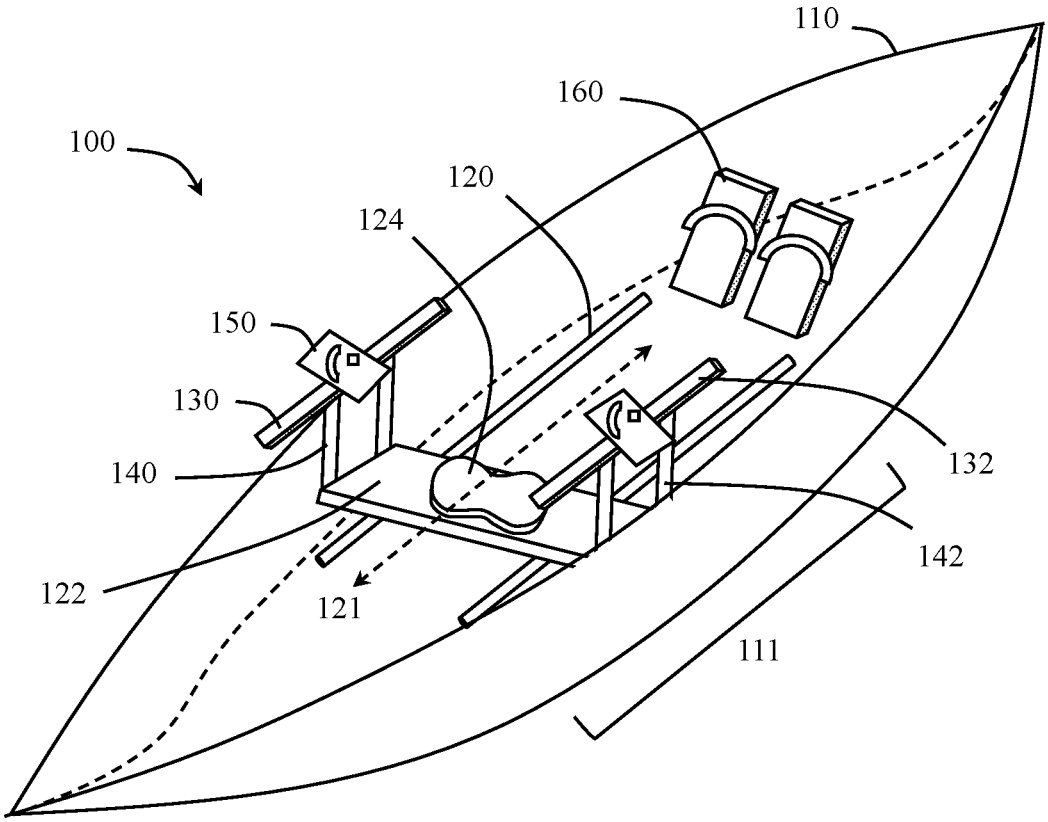
FIG. 3 shows the boat adaptation assembly of FIG. 2 mounted to a boat shell.

For example, FIG. 2 shows an example of a boat adaptation assembly 100 according to embodiments of the present disclosure, and FIG. 3 shows the boat adaptation assembly 100 assembled to a boat body 110. The boat adaptation assembly 100 may include at least one lower rail 120 and a seat support 122 slidably mounted to the at least one lower rail 120. For example, in some embodiments, the seat support 122 may be slidably mounted to a single central lower rail 120. In some embodiments, such as shown in FIG. 2, the seat support 122 may be slidably mounted to two lower rails, a first lower rail 120*a* and a second lower rail 120*b* (collectively referred to as 120). The lower rail(s) may be mounted on the boat body 110, for example, using one or more fasteners, connectors, brackets, and/or rail supports. Further, the lower rail(s) 120 may be mounted on the boat body 110 to extend axially along a partial length 111 of the boat body 110.

The seat support 122 may be slidably mounted to at least one rail using different types of bearings, including, for example, roller bearings, ball bearings, thrust bearings, and sliding bearings. Further, a seat 124 may be mounted to or integrally formed with the seat support 122.

In some embodiments, foot supports 160 may be mounted in the boat body 110 spaced apart from the seat support 122. When a rower is seated in the seat support 122, the rower's feet may be extended an axial distance from the seat support to be secured to the foot supports 160, where the rower may push off and pull from the foot supports 160 to slide the seat support 122 back and forth during rowing in an axial direction 121 (parallel with a central longitudinal axis of the lower rails extending along the length dimension of the lower rails). For example, straps may be used to hold a rower's feet in foot supports, and when held in the foot supports, the rower may push away from the foot supports during a first part of a rowing stroke, and the rower may pull toward the foot supports during a second part of a rowing stroke.

An upper set of rails 130, 132 may be connected to the seat support 122 with at least one rail support 140, 141, 142, 143 supporting each upper rail 130, 132 in the upper set of rails. As shown, the upper set of rails 130, 132 includes a first upper rail 130 and a second upper rail 132 positioned on opposite lateral sides of the seat 124. The first upper rail 130 may be supported by two rail supports 140, 141, and the second upper rail 132 may be supported by two rail supports 142, 143. In some embodiments, an upper rail may be supported by a single rail support. In some embodiments, an upper rail may be supported by more than two rail supports. The rail supports may be connected to the seat support 122 (e.g., by welding, fastening, etc.) or by integrally forming the rail supports with the seat support. The upper rails 130, 132 may be indirectly connected to the seat support 122 via the rail supports.

According to embodiments of the present disclosure, the upper rails 130, 132 may be pivotably mounted to the rail supports 140, 141, 142, 143, such that the upper rails 130, 132 may pivot about an axis parallel with the longitudinal axis of the upper rail 130, 132. For example, an upper rail 130, 132 may be pivotably mounted to one or more rail supports using one or more hinges.

Further, the upper rails 130, 132 may be connected to the seat support 122 in manner where the central longitudinal axes 131 of each upper rail 130, 132 is parallel with the central longitudinal axis of the lower rails 120 and the axial direction 121 in which the seat assembly may slide.

A paddle holder 150, 152 may be slidably mounted to each of the upper rails 130, 132. For example, the paddle holders 150, 152 may be slidably mounted to the upper rails 130, 132 using bearings (e.g., roller bearings, ball bearings, linear motion bearings, etc.) provided between the paddle holder 150, 152 and the upper rail 130, 132, such that each paddle holder 150, 152 may slide along an axial length of the upper rail 130, 132 on which the paddle holder 150, 152 is connected, in axial direction 121. A paddle holder 150, 152 may slide along substantially the entire axial length of an upper rail 130, 132, or a paddle holder 150, 152 may slide along a partial axial length (less than the entire axial length) of an upper rail 130, 132. For example, in some embodiments, two spaced apart stoppers may be provided along an upper rail 150, 152, such that a paddle holder 150,152 may slide along a partial axial length of the upper rail 150, 152 between the two stoppers. In some embodiments, the connections between an upper rail 150, 152 and rail supports 140-143 may act as stoppers between which a paddle holder 150, 152 may slide.

The paddle holders 150, 152 may have a base 151 and one or more paddle retaining elements 153 attached to the base 151. For example, a latch, a strap, an expandable band, a u-hook, or other expandable retaining element may be attached to a paddle holder base and used to clamp around a paddle.

Figure 4:
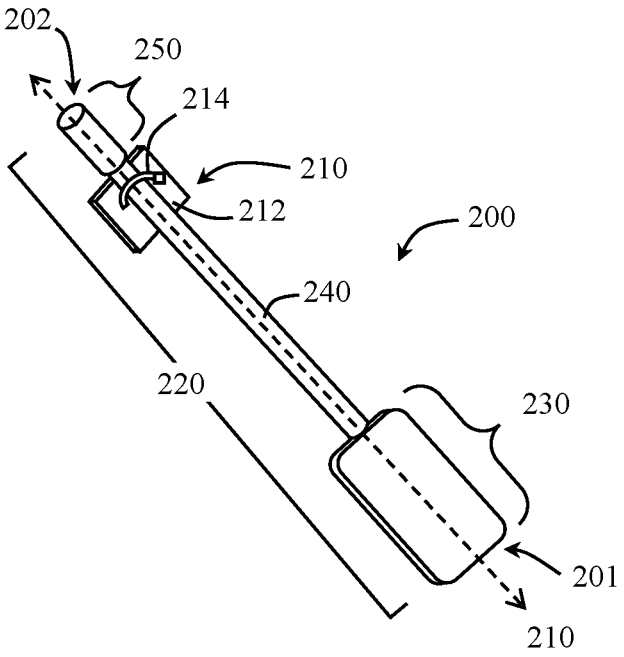
FIG. 4 shows a paddle connected to a paddle holder according to embodiments of the present disclosure.

FIG. 4 shows an example of a paddle 200 retained in a paddle holder 210. The paddle 200 has a total length 220 measured along a central longitudinal axis 222 of the paddle and extending between a first axial end 201 and a second axial end 202. A blade 230 is at the first axial end 201 of the paddle 200, and a shaft 240 extends from the blade 230 to the second axial end 202 of the paddle 200. A portion of the shaft 240 may be positioned in the paddle holder 210 such that the shaft 240 is rotatable about the central longitudinal axis 222 within the paddle holder 210. For example, the paddle holder 210 may have a base 212 and a retaining element 214 connected to or connectable to the base 212, and when the retaining element 214 is in a latched or connected configuration to the base 212, the retaining element 214 may extend around the shaft 240 (e.g., the retaining element 214 may extend around the entire circumference of the shaft 240 or the retaining element and base together may extend around the entire circumference of the shaft 240). The hole created by the latched or connected retaining element 214 may have an inner diameter that is greater than the diameter of the shaft 240, such that shaft 240 may rotate within the retaining element 214.

In some embodiments, a paddle 200 retained in a paddle holder 210 may also have at least one paddle stop positioned along the shaft 240 around one or both sides of the latched or connected retaining element 214, which may be used to prevent an amount of axial movement of a retained paddle 200 through the retaining element 214. For example, a paddle stop may be provided along the shaft 240 proximate to the second axial end 202 of the paddle 200, wherein the paddle stop has an outer dimension greater than the inner diameter of a latched or connected retaining element 214. In the embodiment shown, the paddle stop is a handle 250 having an outer dimension greater than the inner diameter of the retaining element 214, such that when the paddle 200 is retained in the paddle holder 210, the retained paddle 200 may not axially slide out of the retaining element 214.

According to embodiments of the present disclosure, paddle holders may be pivotably mounted to a boat adaptation assembly, such that the paddle holder may tilt a retained paddle into the water around the boat in which the boat adaptation assembly is mounted. Unlike in conventional backward facing row boats, some embodiments may have a connected paddle be pivotable around a single axis that is parallel with the central longitudinal axis of a rail (either upper or lower rail) while being substantially non-rotational relative to an axis perpendicular to the rail central longitudinal axis and extending into the water. In such embodiments, because the paddle may not be free to pivot in a generally axial backward and forward direction, the paddles may instead be moved in an axial backward and forward direction by sliding the entire paddle along the connected upper rail. In other embodiments, a connected paddle may have some freedom of rotational movement around an axis perpendicular to the rail central longitudinal axis and extending into the water (such that the paddle blade may have some axial forward and backward movement by pivoting the paddle) in addition to being moved in an axial backward and forward direction by sliding the entire paddle along the connected upper rail. Regardless of a connected paddle's backward and forward pivoting capability, the paddle (via the connected paddle holder) may be pivotal relative to a central plane of a boat adaptation assembly, the central plane extending centrally through the boat adaptation assembly and along the length of the boat adaptation assembly. When pivotably mounted, a paddle holder (and connected paddle) may have a longitudinal axis that may slope at different angles from the central plane of the boat adaptation assembly.

Figure 5:
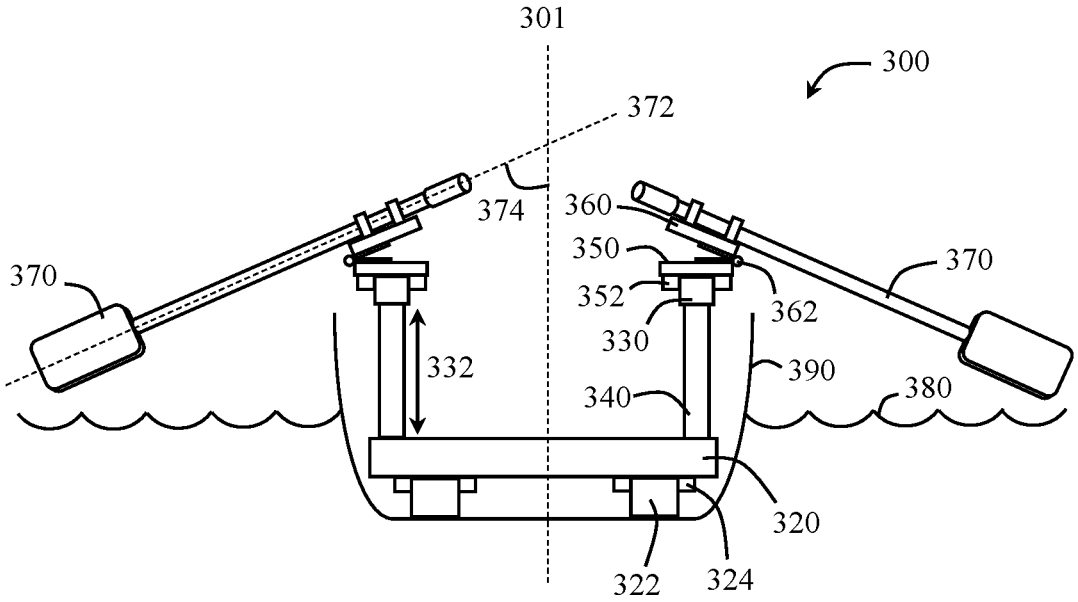
FIGS. 5 and 6 show cross sectional views a boat according to embodiments of the present disclosure along a plane perpendicular to the length of the boat with retained paddles tilted out of the water and in the water around the boat.
Figure 6:
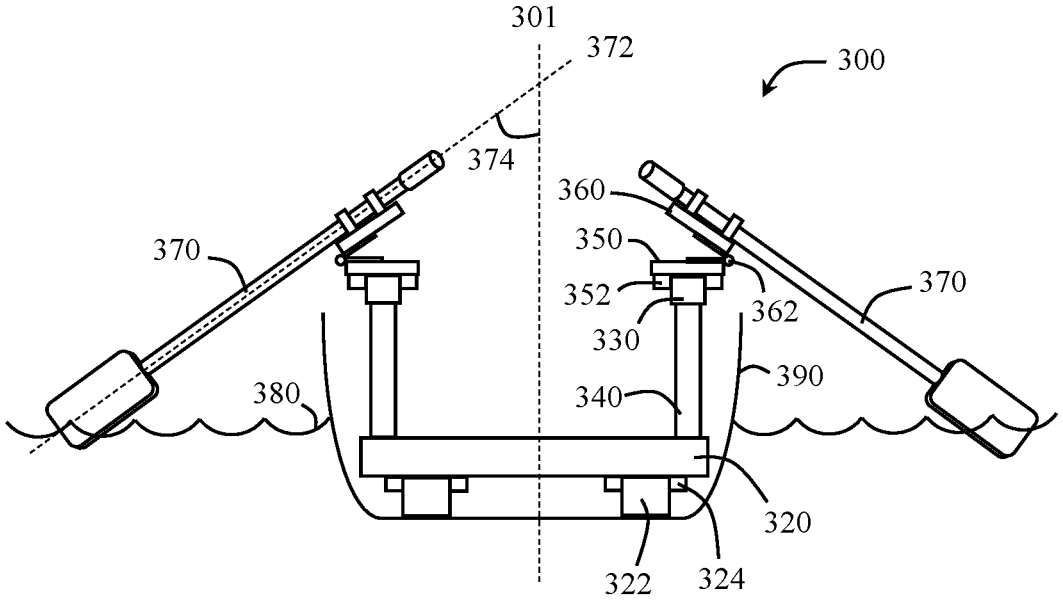

For example, FIGS. 5 and 6 show an example of a boat adaptation assembly 300 having paddle holders 310 that are pivotable relative to a central plane 301 extending centrally through the boat adaptation assembly 300 and along the length of the boat adaptation assembly 300. In the embodiment shown, the boat adaptation assembly 300 is shown in a cross-sectional view along a plane perpendicular to the length of the boat adaptation assembly 300 and perpendicular to the central plane 301. The boat adaptation assembly 300 includes a seat support 320 slidably mounted to at least one lower rail 322, e.g., using roller bearings 324. Upper rails 330 may be held above the sides of the seat support 320 by at least one rail support 340. According to embodiments of the present disclosure, upper rails 330 may be positioned a height 332 above the seat support 320 ranging from about 0.5 ft to about 1.7 ft, for example. In some embodiments, the height 332 may be adjustable, for example, using concentrically arranged and slidable support arms and locking pins to hold the support arms at different relative axial positions. Other adjustable mechanisms may include, for example, gears, hydraulics, a motor, and others, which may be used in combination with different locking mechanisms to hold the support arms at different axial positions. The height 332 of the upper rails 330 may be adjustable, for example, to correspond with a distance between the seat support 320 and a person's shoulders when seated in the seat support 320.

Sliders 350 may be slidably mounted to the upper rails 330, such that each slider 350 is slidable along a length of the upper rail 330. A slider 350 may be slidable along a partial length of an upper rail between two stoppers along the upper rail 330, such as between two rail supports 340. The sliders 350 may be slidable along the upper rails 330 using bearings, such as roller bearings 352.

A paddle holder 360 may be mounted to each slider 350. The paddle holder 360 may include a base and at least one retaining element that may clasp around the shaft of a paddle 370 to retain the paddle 370 to the paddle holder 360. In some embodiments, a paddle holder 360 may be pivotably connected to a slider 350, such that the paddle holder 360 may rotate about a pivot point with respect to the slider 350. For example, a paddle holder 360 may be pivotably connected to a slider 350 using a hinge 362 disposed between the slider 350 and the paddle holder base.

When a paddle 370 is retained in the paddle holder 360 the paddle holder 360 may be pivoted to orient the paddle 370 at an angle 374 measured from the central plane 301 of the boat adaptation assembly 300, the central plane 301 extending parallel to and between the upper set of rails 330. The angle 374 may be measured between the central plane 301 and a longitudinal axis 372 of the paddle 370, or between the central plane 301 and a longitudinal axis of the paddle holder 360. When a paddle 370 is retained in a paddle holder 360, the longitudinal axis 372 of the paddle 370 may be substantially parallel with a longitudinal axis of the paddle holder 360.

In some embodiments, a biased pivot connection may be used to pivotably connect a paddle holder 360 to a slider 350, which may bias the paddle holder 360 to a certain angle 374 with respect to the central plane 301. For example, a biased pivot connection may include at least one spring, such as in a spring loaded hinge, which may bias a paddle holder 360 to slope radially outward and downward with respect to the central plane 301 of the boat adaptation assembly 300. In some embodiments, a biased pivot connection may urge a connected paddle holder 360 in an orientation that keeps a retained paddle 370 in the water 380 when the boat 390 is in the water 380.

The pivotable connection may allow for a paddle holder 360 to move a retained paddle 370 in and out of water 380 surrounding the boat 390 in which the boat adaptation assembly 300 is assembled. For example, as shown in FIG. 5, the paddle holder 360 may be tilted to move the blade of a retained paddle 370 out of the water 380, and as shown in FIG. 6, the paddle holder 360 may be tilted to move the blade of the retained paddle 370 in the water 380, wherein the angle 374 of the paddle holder rotation is greater when the paddle 370 is out of the water 380 than when the paddle 370 is in the water 380. The blade of the retained paddle 370 may be tilted into the water 380 during a drive phase of a stroke (to move the boat 390 forward through the water 380), and the retained paddle 370 may be tilted to bring the blade out of the water 380 during a recovery phase of the stroke (when the rower moves from the finish position back to the catch position).

In some embodiments, the pivotal connection between the paddle holder 360 and the slider 350 (or between a paddle holder and rail support in embodiments have the upper rail pivotably connected to the rail support, such as described more below) may allow an angle 374 that is 90 degrees or less between the longitudinal axis 372 of the paddle 370 and the central plane 301. In some embodiments, the pivotal connection may allow an angle 374 that is less than 180 degrees (e.g., including an angle 374 ranging between 90 and 180 degrees as well as less than 90 degrees) measured between the longitudinal axis 372 of the paddle 370 and the central plane 301. The paddle holder 360 may be pivoted to an acute angle 374 to move a connected paddle blade in the water 380, and the paddle holder 360 may be pivoted to a greater angle 374 in order to move the connected paddle blade out of the water 380.

Figure 7:
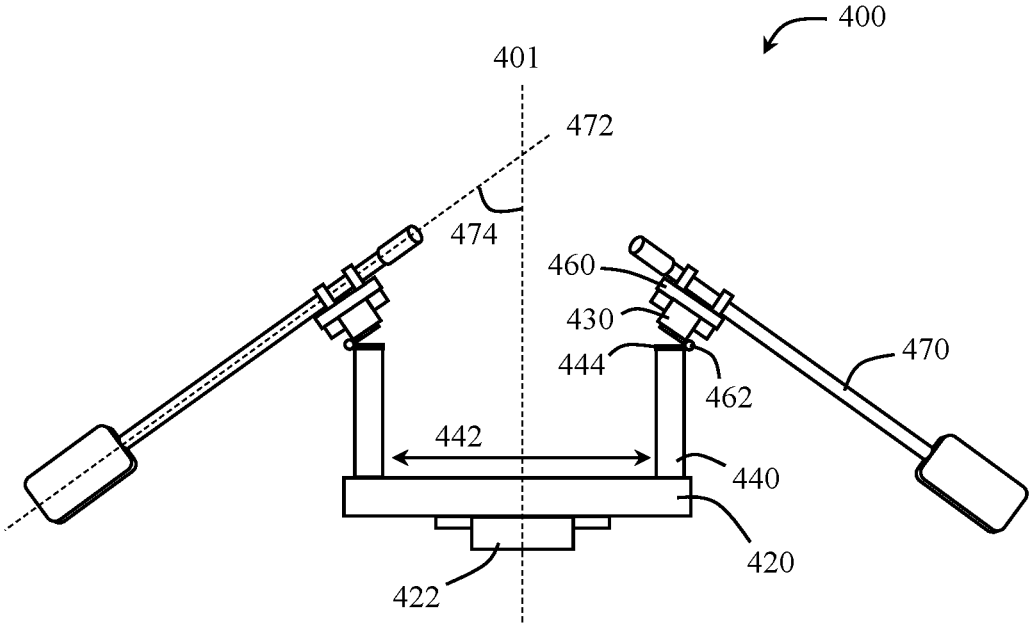
FIG. 7 shows a cross sectional view of a boat adaptation assembly according to embodiments of the present disclosure along a plane perpendicular to the length of the boat adaptation assembly.

A paddle holder may be pivotably connected to a boat adaptation assembly using configurations other than the one shown in FIGS. 5 and 6. For example, as shown in FIG. 7, a paddle holder 460 may be pivotably connected to a boat adaptation assembly 400 by providing at least one pivot connection between an upper rail 430 and at least one rail support 440. In such embodiments, the paddle holder 460 may be tilted in different orientations relative to a central plane 401 of the boat adaptation assembly 400 through its connection to the upper rails 430, where each upper rail 430 may be pivotably connected to the rail supports 440.

In the embodiment shown, a seat support 420 may be slidably mounted to a lower rail 422, and rail supports 440 may be connected to opposite sides of the seat support 420. The rail supports 440 may be spaced far enough apart to allow a rower to sit in between the rail supports 440 connected at the opposite sides of the seat support 420. For example, rail supports 440 on opposite sides of a seat support 420 may be spaced a distance 442 apart ranging between about 1.5 ft and 3 ft. A pivot connection, such as a hinge 462, may be connected at a top end 444 of each rail support 440 to pivotably connect an upper rail 430 to the top end 444 of the rail supports 440.

In some embodiments, at least one biased pivot connection may be used to connect the upper set of rails 430 to the rail supports 440. For example, a pneumatic cylinder may be positioned at one side of a connection area between an upper rail and a rail support, where the pneumatic cylinder may bias the upper rail (and connected paddle holder 460) to tilt a retained paddle 470 at an angle 474 measured between a longitudinal axis 472 of the paddle 470 and a central plane 401 of the boat adaptation assembly 400. In some embodiments, a biased pivot connection may include one or more springs or other compressible elements.

In the embodiment shown, the paddle holder 460 may be a slider (where the paddle holder and the slider may be formed as a single component) that is slidably mounted to the upper rails 430. When the upper rails 430 are tilted via the pivot connections 462, the connected paddle holder 460 is likewise tilted with the upper rails 430. The paddle holder 460 may be directly mounted to an upper rail 430 and slidable in an axial direction along a length of the upper rail 430 using bearings.

Different types of bearings may be used in embodiments of the present disclosure, for example, to slidably mount a seat support to a lower rail and to slidably mount a paddle holder (or slider) to an upper rail. Suitable bearing types that may be used with embodiments disclosed herein include, for example, roller bearings, ball bearings, and linear motion bearing systems, e.g., including belt, fluid, magnetic, compound slides, and roller guide linear motion systems.

A forward-facing rowing boat according to embodiments of the present disclosure may be made, for example, using a seat support slidably connected to at least one lower rail, wherein the seat support is slidable along an axial length of the lower rail. Such slidable seat assemblies may be found in conventional rear-facing rowing boats. However, unlike in conventional rear-facing rowing boats, forward-facing boats according to embodiments of the present disclosure have a boat adaptation assembly including an upper rail system allowing a rower to face forward as the rower slides in the slidable seat assembly.

For example, according to methods of the present disclosure, a first upper rail may be attached to a slidable seat support using at least one first rail support, and a second upper rail may be attached to the slidable seat support using at least one second rail support at a side of the seat support opposite from the first rail support. Paddle holders may be slidably mounted to each of the first and second upper rails. In some embodiments, the first upper rail and the second upper rail may each be pivotably connected to the rail supports. In other embodiments, the upper rails may be fixedly connected to the rail supports, and paddle holders may be pivotably mounted to sliders that are slidably mounted to the upper rails (e.g., as shown in FIGS. 5 and 6).

In some embodiments, rail supports between the seat support and upper rails may be integrally formed with the slidable seat assembly. In other embodiments, rail supports may be connected to the seat support at connection points (e.g., with bolts, brackets, welding, latching mechanisms, etc.). For example, according to some embodiments of the present disclosure, an upper rail system including upper rails connected to rail supports may be connected to a slidable seat assembly (prior to or after attaching the slidable seat assembly to a boat) by connecting the rail supports to the seat assembly.

In some embodiments, a boat adaptation assembly including a slidable seat assembly and an attached upper rail system (e.g., such as shown in FIG. 2 and FIG. 7) may be mounted to a boat shell or body after assembling the boat adaptation assembly. For example, a boat adaptation assembly may be attached to a boat shell or body after assembling the boat adaptation assembly by attaching the lower rail(s) of the boat adaptation assembly to the boat. In some embodiments, a boat adaptation assembly may be assembled after assembling a slidable seat assembly to a boat. For example, in some embodiments, a conventional rowing boat having a slidable seat assembly may be modified to be a front-facing row boat as described herein by attaching an upper rail system to the slidable seat assembly using rail supports to connect upper rails on both lateral sides of the slidable seat assembly.

Figure 8:
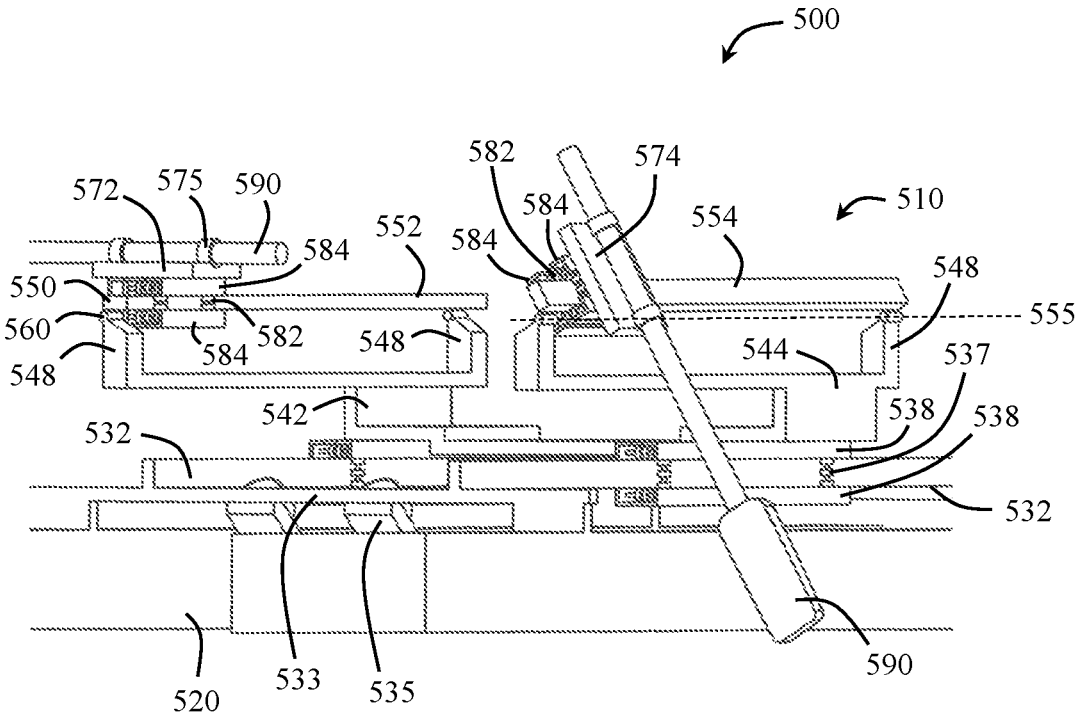
FIGS. 8-10 show views from different perspectives of a boat according to embodiments of the present disclosure.
Figure 9:
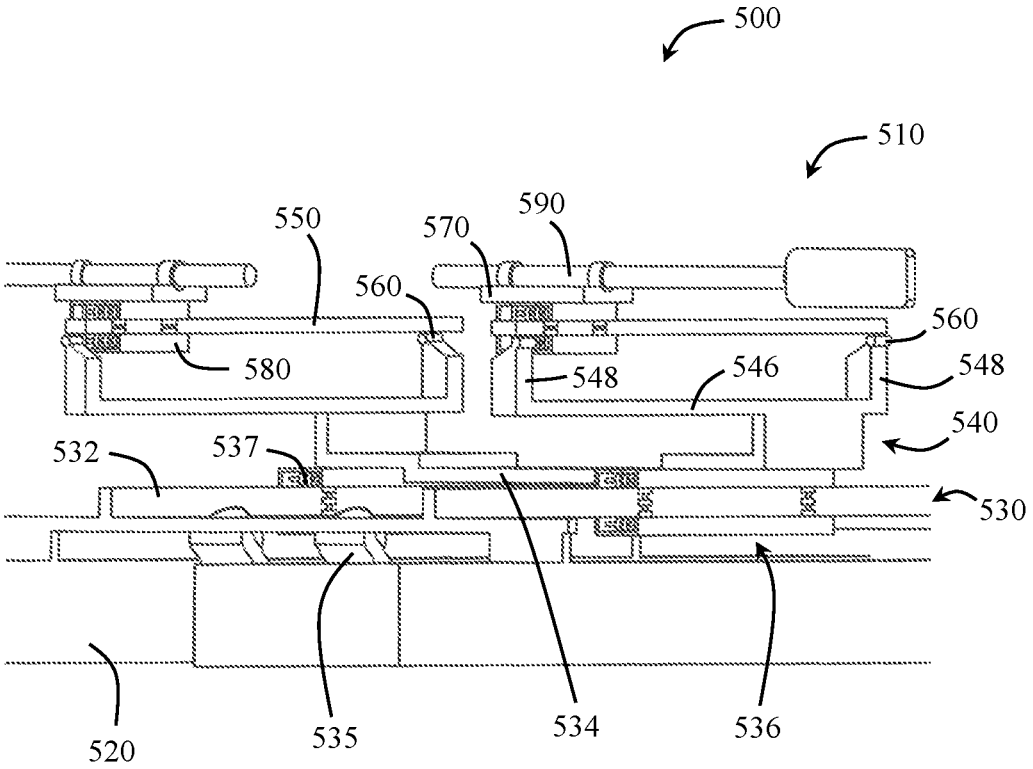
Figure 10:
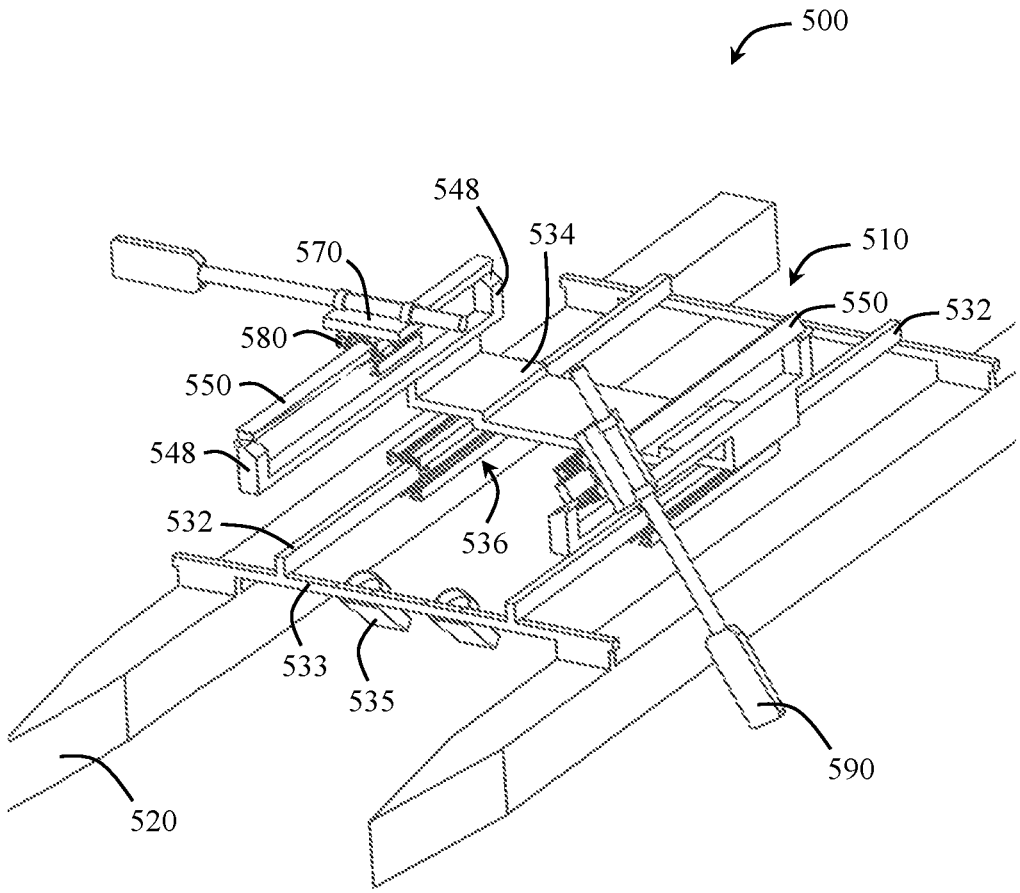

FIGS. 8-10 show an example of a rowing boat 500 according to embodiments of the present disclosure having a boat adaptation assembly 510 attached to a boat shell 520. The boat adaptation assembly 510 may include a sliding seat assembly 530 attached to the boat shell 520. The sliding seat assembly 530 may include at least one lower rail 532 extending parallel with the length of the boat shell 520 and a seat support 534 slidably mounted to the lower rail 532. A seat may be disposed on or integrally formed with the seat support 534 for a rower to sit on during rower. In the embodiment shown, the seat support 534 may be slidably mounted to two lower rails 532 using roller bearing assemblies 536. A roller bearing assembly 536 may include roller bearings 537 held around one or more sides of a lower rail 532 by connectors 538 and/or bearing housings. In the embodiment shown, roller bearings 537 may be held around all four sides of a lower rail 532. In other embodiments, roller bearings may be held around less than all sides of a lower rail (e.g., around 2 or 3 sides of the lower rail). Further, in some embodiments, a lower rail may have a rectangular or square cross-sectional shape (e.g., as shown in FIG. 8), or may have a different cross-sectional shape (e.g., a circular cross-sectional shape).

The lower rails 532 may be spaced apart and arranged parallel to each other. At least one connecting bar 533 may extend between and connect the lower rails 532. In the embodiment shown, a first connecting bar 533 may extend between a first end of each lower rail 532 and may have foot supports 535 attached to the connecting bar 533. When a rower is seated in the seat support 534, the rower may place their feet in the foot supports 535 to slide the seat support 534 along the lower rails 532. In some embodiments, two or more connecting bars may be provided and extend between the lower rails to provide more stability to the alignment of the lower rails.

Rail supports 540 may be attached at opposite lateral sides of the seat support 534 and extend a height above the seat support 534. For example, rail supports 540 may include two rail supports 542, 544 (collectively referred to as 540), a first rail support 542 on a first side of the seat support 534 and a second rail support 544 on a second side of the seat support 534. Each rail support 540 may include multiple support structures, for example, a horizontal support 546 and multiple vertical supports 548.

Each rail support 540 may support an upper rail 550, connecting the upper rails 550 to the seat support 534, wherein the set of upper rails 550 and connected seat support 534 are slidable with respect to the lower rails 532. In the embodiment shown, the vertical supports 548 of the rail supports 540 may be pivotably connected to upper rails 550 via pivot connections 560. The set of upper rails 550 may include a first upper rail 552 and a second upper rail 554 positioned on opposite lateral sides of the seat support 534. Each of the first and second upper rails 552, 554 may be pivotably mounted to the respective rail supports 542, 544, such that each of the first and second upper rails 552, 554 partially rotate around an axis 555 parallel with the first and second upper rails 552, 554. For example, as shown in FIG. 8, the first upper rail 552 is rotated in a horizontal orientation (e.g., where a longitudinal axis of a connected paddle holder 570 may be substantially perpendicular with a central plane of the boat adaptation assembly 510), and the second upper rail 554 is rotated in a tilted orientation (e.g., where a longitudinal axis of a connected paddle holder 570 may be at an angle less than 90 degrees with respect to the central plane of the boat adaptation assembly 510). Further, in the embodiment shown, each axial end of the upper rails 550 may be pivotably connected to vertical supports 548 of the rail supports 540. In other embodiments, at least a portion of a rail support may be connected to an upper rail between the axial ends of the upper rail (e.g., in a central portion of the upper rail).

Paddle holders 570 may be slidably mounted to the upper rails 550, where a first paddle holder 572 may be slidably mounted to the first upper rail 552, and a second paddle holder 574 may be slidably mounted to the second upper rail 554. Upper bearings 580 may be provided between the paddle holders 570 and the upper rails 550 to allow the connected paddle holders 570 to slide along an axial length of the upper rails 550. For example, the upper bearings 580 may include roller bearings 582 held around the upper rails 550 by bearing connectors 584 or bearing housings. The connection points between the upper rails 550 and the vertical supports 548 of the rail supports 540 may act as stoppers, where the paddle holder 570 may slide along the upper rail 550 between the connection points.

Paddles 590 may be held in the paddle holders 570 using retaining elements 575. When the paddles 590 are held in the paddle holders 570, a rower may maneuver the handle portions of the paddles 590 to tilt the paddles 590 (and connected paddle holders 570 and upper rails 550) in different tilted orientations. When the upper rails 550 are in a first tilted orientation, the blade portion of the retained paddles 590 may be inserted into water surrounding the boat shell 520. When the upper rails 550 are in a second tilted orientation, the blade portion of the retained paddles 590 may be lifted out of the water. Further, according to embodiments of the present disclosure, the paddles 590 may be rotated about their longitudinal axes while retained in the paddle holders 570. In such embodiments, a rower may rotate the paddles 590 to rotationally orient a blade portion of the paddle 590 to where the face of the blade faces up (e.g., where the face of the blade may be substantially parallel with a plane extending through the length and width dimensions of the paddle holder base). In such a face up rotational orientation, a rower may move the paddle above the water, e.g., during a recovery phase of a rowing stroke. A rower may rotate the paddles 590 to rotationally orient a blade portion of the paddle 590 at an angle from the face-up rotational orientation, in which rotational orientation at least a portion of the blade may be inserted into and transverse the water around the boat shell 520, e.g., during a drive phase of a rowing stroke.

FIGS. 11-16 show an example of a rowing stroke using a boat according to embodiments of the present disclosure. The examples show a rower 600 seated in a row boat 610 according to embodiments of the present disclosure, where the rower 600 is facing forward, in the same direction that the boat 610 is moved forward. The row boat 610 may include a boat adaptation assembly 612 mounted to a boat shell 614, which may include, for example, pontoons, a canoe shell, and/or other floatation structures. The rower 600 may maneuver paddles 620 held by slidable paddle holders 625 of the boat adaptation assembly 612 to row the boat 610 forward.

Figure 11:
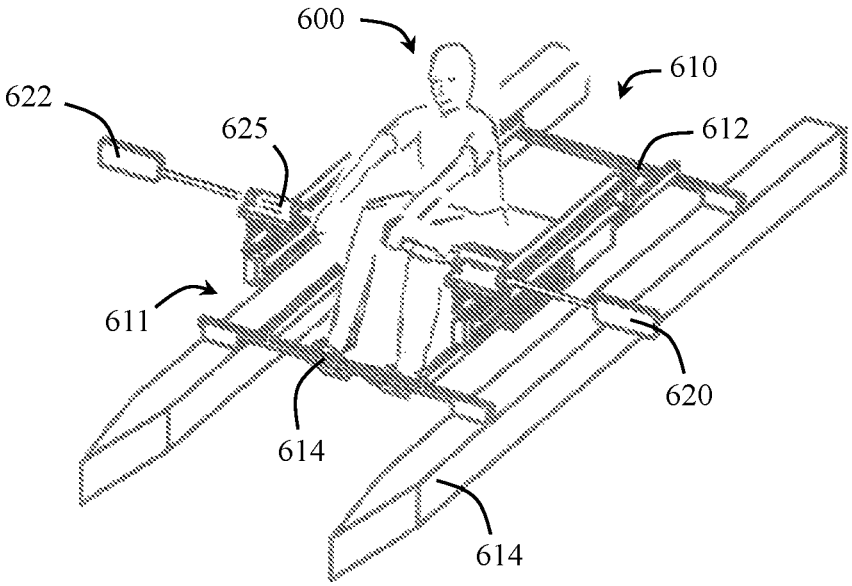
FIGS. 11-16 show different stages of a rowing stroke using a boat according to embodiments of the present disclosure.

FIG. 11 shows the rower 600 facing forward, with arms straight, grasping the handles of the paddles 620, and having both legs bent, such that the slidable seat assembly and attached upper rail system in the boat adaptation assembly 612 and the paddles 620 may be maneuvered to as far forward as possible. Such a position may be referred to as a forward position, where the paddles 620 may be moved to be in position for the catch part of the stroke. In other words, the forward position may refer to the position of the rower 600, components in the boat adaptation assembly 612, and paddles 620 in which the blades 622 of the paddles 620 are above the water 630 and immediately before the catch phase of the stroke (described more below). In some embodiments, the slidable seat assembly and/or the paddles 620 may be maneuvered toward a front end 611 of the boat adaptation assembly 612, but not as far forward as possible, to be in the forward position. The rower 600 may strap his or her feet into foot supports 614 (or use another component in the boat 610 that the rower 600 may use to lever his or her feet to) in order to move the slidable seat forward as the legs are bent and to move into the forward position.

Figure 12:
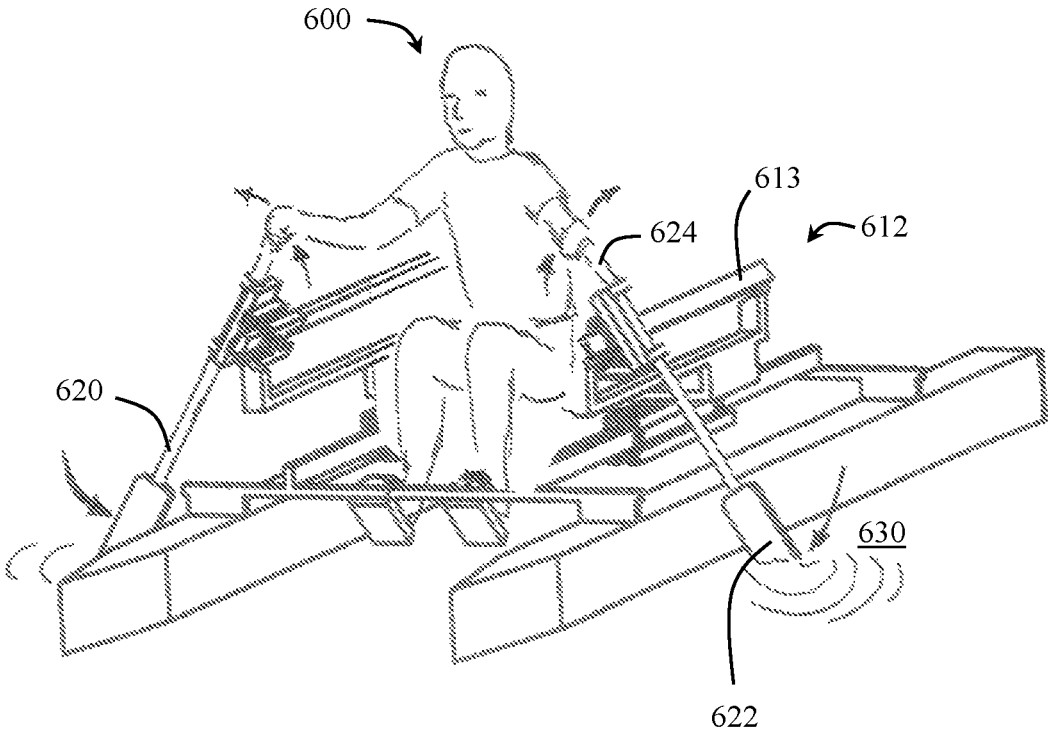

FIG. 12 shows a catch phase of the stroke, where the blades 622 of the paddles 620 are lowered into the water 630 surrounding the boat 610. When in the forward position, the rower 600 may raise the handles 624 of the paddles 622, which may pivot the length of each paddle 620 rotationally around an axis parallel with the length of the upper rails 613 in the boat adaptation assembly 612, thereby moving the blades 622 into the water 630.

Figure 13:
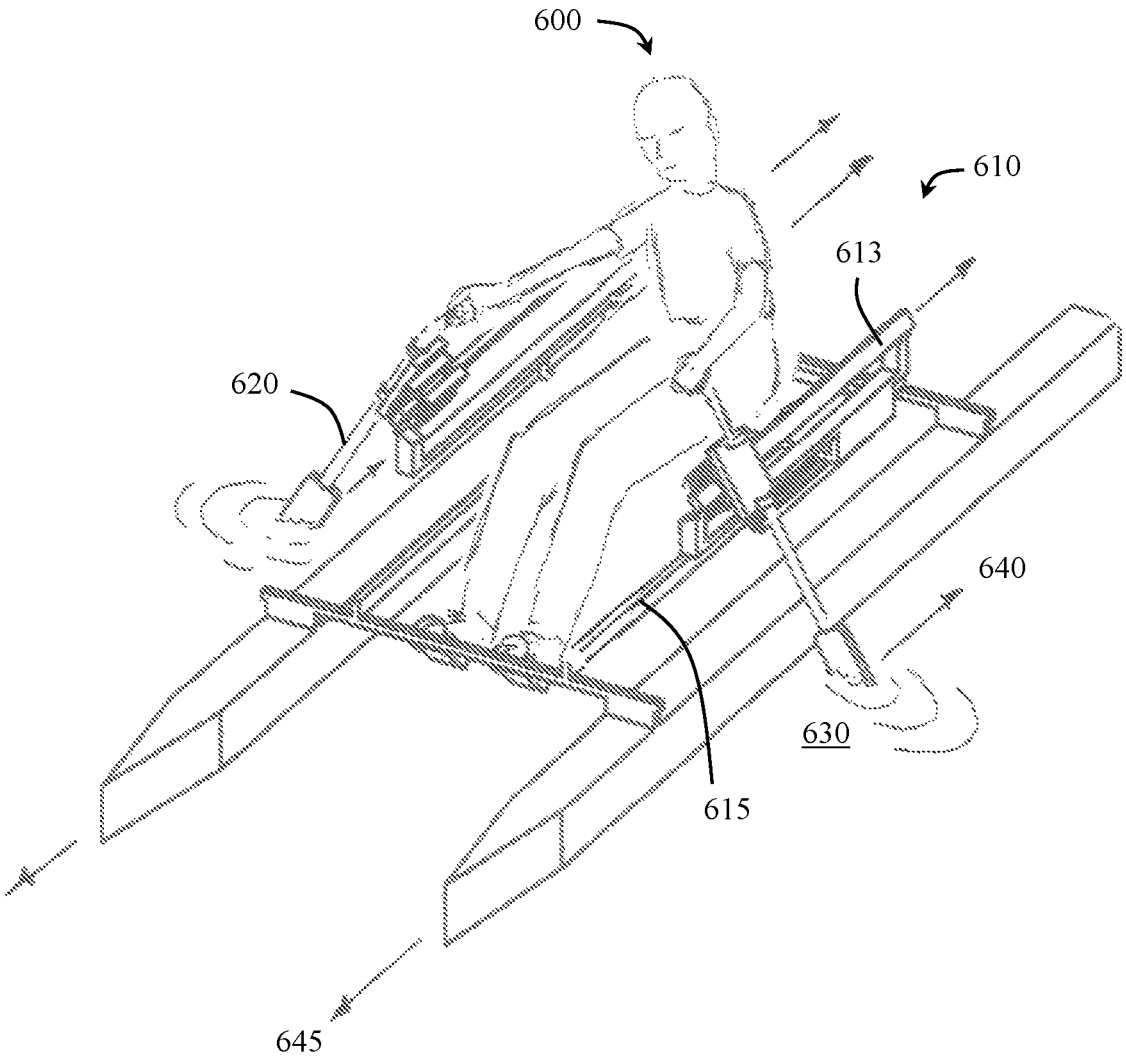

FIG. 13 shows a leg drive phase of the stroke, which may be an early part of the drive phase in the stroke. In this phase, with the rower's feet still secured to the boat and the blades 622 still in the water 630, the rower 600 pushes his or her legs from a bent configuration, such as shown in FIGS. 11 and 12, to a more straightened configuration. Straightening the rower's legs may move the sliding seat (in which the rower is seated) along the lower rails 615 in a backward direction 640. Because the upper rail 613 system is connected to the seat assembly, the upper rails 613 and connected paddles 620 may move backward 640 along with the backward movement of the rower 600. The backward movement 640 of the paddles 620 in the water 630 may cause the boat 610 to move forward 645 in the water 630.

Figure 14:
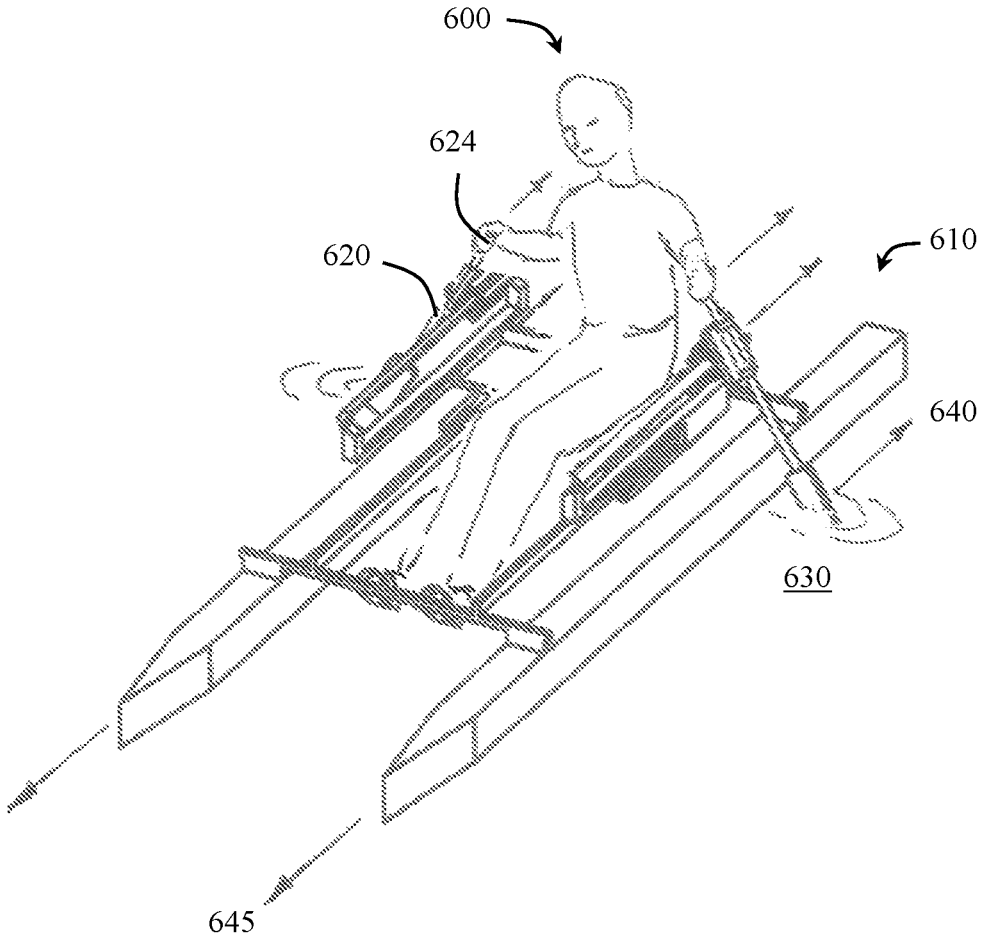

FIG. 14 shows a pull phase of the stroke, which may be a late part of the drive phase of the stroke. In the pull phase, the rower 600 may pull the handles 624 of the paddles 620 with both arms to continue driving the paddles 620 in a backward direction 640 and to move the boat 610 in the forward direction 645. The pull phase of the stroke may be started during the leg drive phase (e.g., toward the end of straightening the legs) or after the leg drive phase (e.g., after the rower 600 has straightened his or her legs to a straightened configuration). Thus, the pull phase of the stroke may be initiated when the rower's legs are either partially straight or entirely straight.

During the drive phase of the stroke (including the leg drive phase as shown in FIG. 13 and the pull phase as shown in FIG. 14), the rower 600 may keep the blades 622 of the paddles 620 at least partially in the water 630 as the paddles 620 are moved backward 640, such that the blades may catch the water to propel the boat forward. The rower 600 may keep the blades 622 in the water by maintaining an upward force on the handles 624 of the paddles 620 to keep the blades 622 pivoted in the water 630. In some embodiments, one or more biasing mechanisms (e.g., a spring) may be provided in the boat adaptation assembly 612 to add a force on the paddles 620 and bias the paddles 620 in a preselected rotational orientation. For example, a biasing mechanism may be provided in a configuration to bias the paddles 620 in a rotational orientation that aids in keeping the blades 622 in the water 630 during the drive phase of the stroke. In some embodiments, a biasing mechanism may be provided in a configuration to bias the paddles 620 in a relatively more horizontal rotational orientation, which may help to keep the blades 622 out of the water 630 during a recovery phase of a stroke (described more below).

Figure 15:
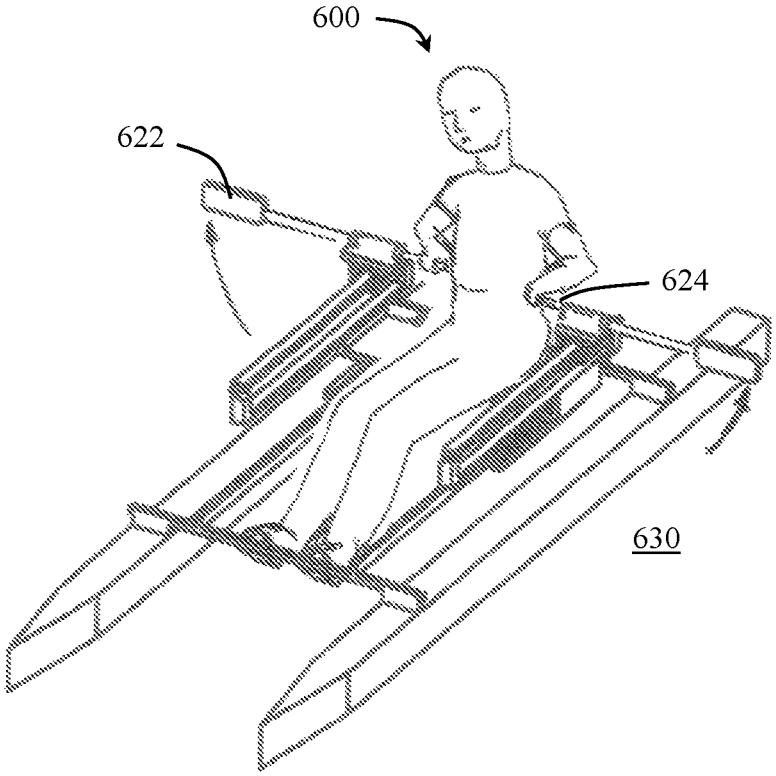

FIG. 15 shows a finish phase of the stroke, where the rower 600 may push down on the handles 624 of the paddles 620 to pivot the paddles 620 and lift the blades 622 out of the water 630. The finish phase of the stroke takes place after the drive phase, and thus the rower 600 may begin the finish phase in the same position as the end of the drive phase, with the rower's legs in a straightened configuration and arms pulled back.

Figure 16:
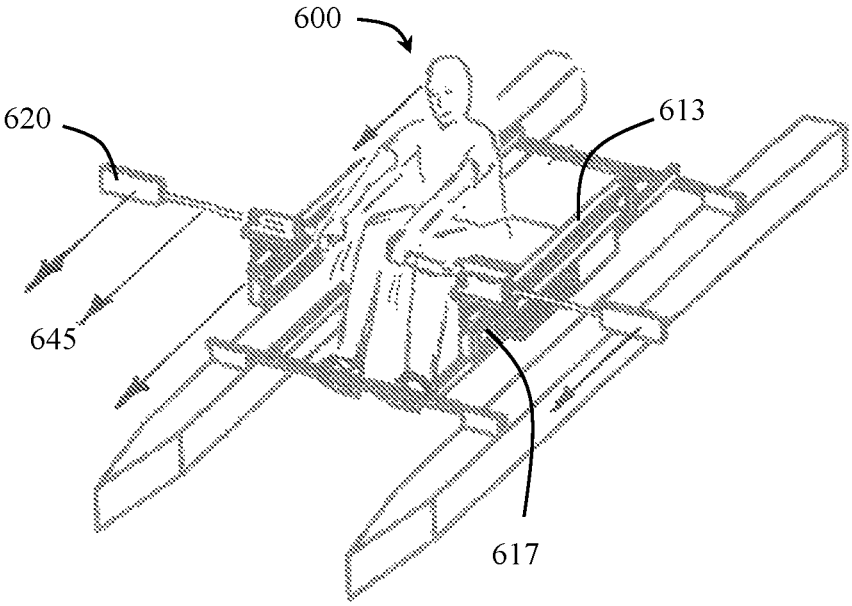

FIG. 16 shows a recovery phase of the stroke. During the recovery phase of the stroke, the rower 600 may use leverage from his or her secured feet to bend his or her legs, which may cause the seat assembly 617 in which the rower is seated to slide in a forward direction 645 along the lower rail(s) in the boat adaptation assembly 612. As the seat assembly 617 slides forward, the connected upper rail system 613 and paddles 620 may also move in a forward direction 645. Further, the rower's arms may be extended to move the paddles 620 in the forward direction 645. In some embodiments, the recovery phase of the stroke may include an early recovery phase where the arms are first extended forward and a late recovery phase where the legs are bent while the arms remain extended forward. At the end of the recovery phase, the rower 600 may be back at the forward position, such as shown in FIG. 11, and ready to begin another stroke.

A person of ordinary skill in the art may recognize that when referring to the description of FIGS. 11-16 additional steps may be performed in a rowing stroke, the order of one or more steps in the stroke may be altered, or one or more steps in the stroke may be omitted.

By using boat and boat adaptation assembly configurations described herein, a rower may be able to row a boat in a forward-facing configuration, where the rower may face in the same direction as he or she propels the boat during rowing. Further, by using boats and boat adaptation assemblies according to embodiments of the present disclosure, a rower may use traditionally-shaped paddles (e.g., having a generally linear configuration extending along a single central longitudinal axis) to row a boat while facing in the same forward direction that the boat is moved.

As described herein, boat adaptation assemblies may include two sets of rails, a lower rail set (e.g., including one or more lower rails on which the seat assembly may slide) and an upper rail set (e.g., including two upper rails on which paddle holders may slide). The upper rails may move with the seat assembly as the seat assembly slides along the lower rail(s). For example, as the seat assembly slides in a backward direction along the lower rail(s), the upper rails may also move in the backward direction with the seat assembly. Paddles connected to the upper rails may thus also move in the same backward direction while the seat assembly is moved in the backward direction. In addition to the axial movement of the upper rails with the seat assembly along the lower rail(s), the paddles may axially slide along the upper rails. In such manner, the paddles may be moved by both the upper and lower set of rails in an axial direction along the length of the boat. Thus, by providing an additional set of rails (the upper rails) on which connected paddles may axially slide along a partial length of the boat, additional backward force may be provided by pulling the connected paddles along the upper rails and moving the blades through the water, which may help provide additional forward motion of the boat.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

The invention claimed is:

1. An apparatus for a boat, comprising:

a rail support extending in a direction from a first axial end to a second axial end;

an upper rail provided at the second axial end of the rail support;

a slider slidably mounted to the upper rail; and a paddle holder pivotably connected to the slider, wherein the paddle holder is rotatable about a pivot point with respect to the slider, wherein the rail support is integrally formed with a seat support for the boat.

2. The apparatus of claim 1, further comprising roller bearings provided between the upper rail and the slider.

3. The apparatus of claim 1, further comprising at least one lower rail and a seat support slidably mounted to the at least one lower rail, wherein the first axial end of the rail support is connected to the seat support.

4. The apparatus of claim 1, further comprising a paddle in the paddle holder, wherein the paddle is rotatable about a central longitudinal axis of the paddle.

5. The apparatus of claim 1, further comprising a second rail support having a second upper rail, wherein the second rail support is integrally formed with the seat support and provided on a side of the seat support opposite the rail support.

6. An apparatus, comprising:

a rail support mounted in a boat, the rail support having a first axial end and a second axial end opposite the first axial end;

an upper rail pivotably connected to the second axial end of the rail support; and a paddle holder slidably mounted to the upper rail.

7. The apparatus of claim 6, further comprising at least one biased pivot connection connecting the upper rail to the rail support.

8. The apparatus of claim 7, wherein the at least one biased pivot connection biases the paddle holder to slope radially outward and downward with respect to the rail support.

9. The apparatus of claim 6, wherein each axial end of the upper rail is pivotably connected to the rail support.

10. The apparatus of claim 6, further comprising, at least one lower rail mounted on the boat and a seat support slidably mounted to the at least one lower rail, wherein the first axial end of the rail support is connected to the seat support.

11. The apparatus of claim 6, further comprising a seat support provided in the boat, wherein the rail support is connected to a first side of the seat support and a second rail support is connected to a second side of the seat support opposite the first side, wherein a second upper rail is pivotably connected to the second rail support, and wherein a second paddle holder is slidably mounted to the second upper rail.

12. The apparatus of claim 6, further comprising a seat support provided in the boat, wherein the rail support is integrally formed at a first side of the seat support and a second rail support is integrally formed at a second side of the seat support opposite the first side, wherein a second upper rail is pivotably connected to the second rail support, and wherein a second paddle holder is slidably mounted to the second upper rail.

13. A rowing boat, comprising:

a boat shell;

a sliding seat assembly mounted on the boat shell, the sliding seat assembly comprising:

a lower rail extending parallel with a length of the boat shell;

a seat support slidably mounted to the lower rail; and a seat disposed on the seat support;

rail supports connecting an upper set of rails to the seat support;

wherein the upper set of rails comprises a first upper rail and a second upper rail positioned on opposite lateral sides of the seat;

wherein each of the first and second upper rails are pivotably mounted to the rail supports, such that each of the first and second upper rails partially rotate around an axis parallel with the first and second upper rails; and wherein the upper set of rails and connected seat support are slidable with respect to the lower rail;

a first paddle holder slidably mounted to the first upper rail; and a second paddle holder slidably mounted to the second upper rail.

14. The rowing boat of claim 13, further comprising two paddles, each paddle comprising:

a length measured along a central longitudinal axis of the paddle and extending between a first axial end and a second axial end;

a blade at the first axial end of the paddle; and a shaft extending from the blade to the second axial end of the paddle;

wherein a portion of the shaft is positioned in the paddle holder and rotatable about the central longitudinal axis.

15. The rowing boat of claim 14, wherein each paddle further comprises a paddle stop positioned along the shaft proximate to the second axial end, wherein the stop has an outer dimension greater than an inner dimension of a paddle retaining element on the paddle holder.

16. The rowing boat of claim 13, wherein the first and second paddle holders each comprise a base and at least one paddle retaining element attached to the base.

17. The rowing boat of claim 13, further comprising at least one roller bearing positioned between at least one of the lower rail and the seat support and the upper rails and the paddle holder.

18. The rowing boat of claim 13, wherein the rail supports comprise:

a first set of rail supports;

wherein the first upper rail is pivotably mounted to the first set of rail supports; and wherein the first paddle holder is slidable along the first upper rail between the first set of rail supports; and a second set of rail supports;

wherein the second upper rail is pivotably mounted to the second set of rail supports; and wherein the second paddle holder is slidable along the second upper rail between the second set of rail supports.

19. An apparatus for a boat, comprising:

a rail support extending in a direction from a first axial end to a second axial end;

an upper rail provided at the second axial end of the rail support;

a slider slidably mounted to the upper rail;

a paddle holder pivotably connected to the slider, wherein the paddle holder is rotatable about a pivot point with respect to the slider; and at least one biased pivot connection connecting the paddle holder to the slider.

* * * * *